United States Patent [19]

Runk

[11] 4,281,725

[45] Aug. 4, 1981

[54] KNUCKLE JOINT SPEARHEAD CORE DRILLING APPARATUS

[75] Inventor: Terry M. Runk, Stillwater, Minn.

[73] Assignee: Longyear Company, Minneapolis, Minn.

[21] Appl. No.: 77,350

[22] Filed: Sep. 20, 1979

[51] Int. Cl.[3] ..... E21B 25/02

[52] U.S. Cl. ..... 175/246; 294/86.13

[58] Field of Search ..... 175/246–248; 166/117.5; 294/86.13; 285/118

[56] References Cited

U.S. PATENT DOCUMENTS

| | | | |
|---|---|---|---|
| 1,738,819 | 12/1929 | Cormier | 294/86.13 |
| 2,829,868 | 4/1958 | Pickard et al. | 175/246 |
| 3,120,283 | 2/1964 | Braun | 175/246 |
| 3,173,719 | 3/1965 | Ringler | 294/86.13 |
| 3,876,001 | 4/1975 | Goode | 166/117.5 |

*Primary Examiner*—Ernest R. Purser

*Attorney, Agent, or Firm*—Clayton R. Johnson

[57] ABSTRACT

Core drilling apparatus that includes a wire line core barrel inner tube assembly movable through a drill stem to be seated in a latched core taking position adjacent the drill stem core bit and an overshot assembly coupled to the inner tube assembly for lowering and/or withdrawing the inner tube assembly in the drill stem. The inner tube assembly includes an overshot coupling assembly having a base member extended into the latch release tube for limited movement relative thereto, a spearpoint assembly connected to the base member for pivotal movement through an angle of about 180° about a transverse pivot axis, and a detent plunger resiliently mounted by the subassembly to extend into a base recess when the central axes of the base and coupling members are nearly aligned to releasably retain said members in relative positions that their axes are aligned, and to abut against a base tapered surface when the subassembly central axis is at a substantial angle relative the base central axis.

14 Claims, 4 Drawing Figures

KNUCKLE JOINT SPEARHEAD CORE DRILLING APPARATUS

BACKGROUND OF THE INVENTION

A wire core barrel inner tube assembly releasably coupled to an overshot assembly for being moved through a drill stem.

In using prior art overshot and core barrel inner tube assemblies, (for example those disclosed in U.S. Pat. No. 3,120,283), if the coupled assemblies are sufficiently elevated by the wire line to completely clear the drill stem and then the inner (lower) end of the inner tube assembly moved away from the drill stem as the coupled assemblies are lowered for laying the assemblies flat on the earth surface, at times the conventional spearpoint will pivot in direction of the overshot dogs whereby the inner tube assembly becomes uncoupled from the overshot assembly and the outer end of the inner tube assembly falls. This can result in injury to the operator and damage to the inner tube assembly. Also in using the above procedure the overshot assembly of a type such as disclosed in U.S. Pat. No. 2,829,868 will bend at the jar staff, which at times results in damage to the overshot assembly.

A conventional procedure is to elevate the coupled overshot and inner tube assemblies sufficiently that the upper end portion of the inner tube assembly is above the drill stem, and then while still coupled, attach a pipe clamp to the upper end portion of the inner tube assembly. Thence a hook attached to the drill rig main hoist cable is hookingly engaged with a cable connected to the clamp and the hook elevated sufficiently that the overshot assembly can be and is uncoupled from the inner tube assembly. Thereafter the wire line hoist is operated to move the overshot assembly out of the way, and the main hoist to elevate the inner tube assembly to clear the drill stem, and while the lower end of the inner tube assembly is manually moved away from the drill stem, the hook is lowered so that the inner tube assembly can be laid flat on the surface. When an inner tube assembly is to be inserted into a drill stem, the pipe clamp is attached to the inner tube assembly, the main hoist operated to elevate the inner tube assembly and then lowered so that the inner tube assembly extends into the drill stem, the wire line hoist operated to move the overshot assembly to couplingly engage the inner tube assembly, the pipe clamp removed and thence the wire line hoist operated to lower the coupled assemblies, provided the inner tube assembly is to be lowered by the use of the overshot assembly. This procedure can be dangerous, and does involve considerable handling of hooks, cables and etc. while switching from wire hoists to main hoists, which is time consuming.

In order to overcome problems such as the above, this invention has been made.

SUMMARY OF THE INVENTION

Wire line core drilling apparatus that includes a core barrel inner tube assembly having a core receiving tube, a latch body connected to the core receiving tube and mounting latches for movement between a latch seat engaging position and a latch retracted position, a latch release tube mounted on the latch body for limited axial movement, and an overshot coupling assembly that includes a base member joined to the latch release tube and an overshot coupling member mounted on the base member for movement about an axis transverse to the direction that the release tube is axially movable relative the latch body.

One of the objects of this invention is to provide in a core barrel inner tube assembly, new and novel means for being couplingly engaged by an overshot assembly. Another object of this invention is to provide new and novel means in a long barrel inner tube assembly for facilitating handling of the assembly during core retrival with a wire line system. In furtherance of the last mentioned object, it is a still further object of the invention to provide a new and novel overshot coupling assembly for a core barrel inner tube assembly that permits an overshot assembly pivoting relative the inner tube assembly through a substantial angle about an axis transverse to the direction of elongation of the inner tube assembly while the overshot assembly is couplingly attached to the inner tube assembly.

Another object of this invention is to provide in a wire line core barrel assembly, a new and novel spearhead assembly that includes a coupling member selectively releasably retained in at least two substantially angularly different positions relative the spearhead assembly base member.

In order that the invention described herein may be more easily understood, the meaning of certain terminology as used in the specification will be set forth. The term "inner" refers to that portion of the drill stem or of an element of an assembly in its position "for use" in the drill stem which is located axially closer to the bit attached to the drill stem than any other portion of the drill stem or elements being referred to except where the term refers to the transverse circumference, or the peripheral surface or the diameter of the drill stem or said element. The term "outer" refers to that portion of the drill stem or of an element in its "position for use" in a drill stem which is located axially closer to the mouth of the drill hole than the outer portion of the drill stem or element being referred to except where the term refers to a transverse circumference or the peripheral surface or the diameter of an element or the drill stem.

BRIEF DESCRIPTION OF THE DRAWINGS

FIG. 1 is a fragmentary cross sectional view through a drill stem, a core barrel inner tube assembly and the lower portion of an overshot assembly with axially intermediate portions broken away, said view being generally taken along the line and in the direction of the arrow 1—1 of FIG. 2 with the core barrel inner tube assembly shown in a lached condition and the overshot assembly in a position just prior to its retracting the latch release tube;

Figures 2, 3, 4, 7:
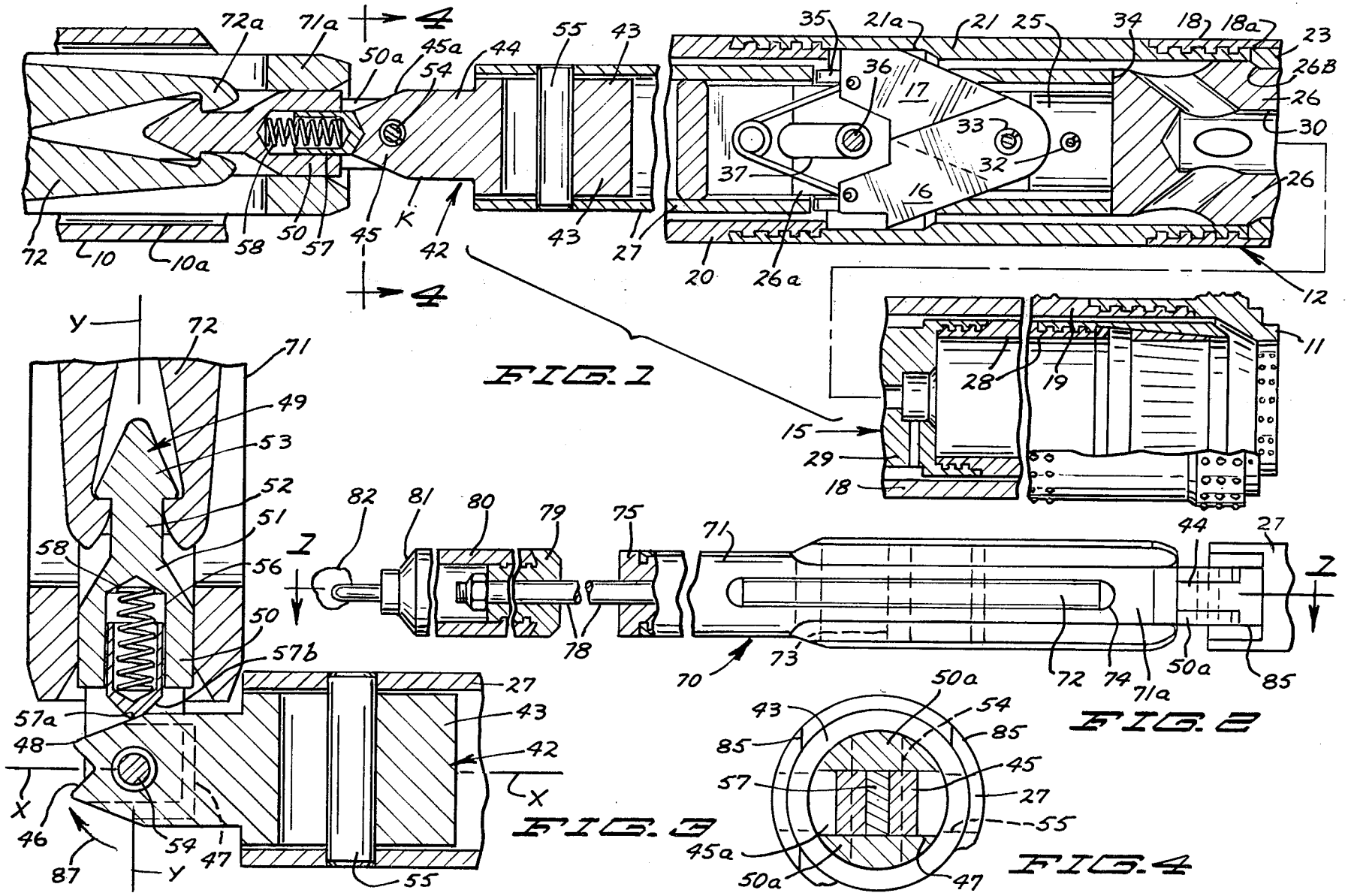
FIG. 2 is a side view of the overshot assembly and the outer end portion of the core barrel inner tube assembly in the relative positions shown in FIG. 1, axial intermediate parts of the overshot assembly being broken away and part of the overshot assembly being shown in cross section.
FIG. 3 is a fragmentary cross sectional view of the outer end portion of the core barrel inner tube assembly and the inner end portion of the overshot assembly with the overshot assembly in a 90° position relative the core barrel inner tube assembly.
FIG. 4 is a cross sectional view generally taken along the line and in the direction of the arrows 4—4 of FIG. 1 showing the plunger seated in the base member recess.

Referring in particular to FIGS. 1 and 2, there is illustrated a hollow drill stem 10 which is made up of sections of pipe coupled together and having an annular bit 11 mounted on the inner end thereof. The portion of the drill stem attached to or extending inwardly of pipe section 10*a* is commonly referred to as a core barrel outer tube assembly, generally designated 12, which is provided for receiving and retaining a core barrel inner tube assembly, generally designated 15. Details of the construction of a core barrel outer tube assembly that may be used with this invention are more fully set forth in U.S. Pat. No. 3,461,981. The assembly 12 includes a core barrel outer tube 18, a reaming shell 19, and an annular core bit 11 threadedly connected to the inner end of the reaming shell for drilling into the earth formation from which the core sample is to be taken. The outer (upper) end of assembly 12 includes a lock coupling 20 which connects one end of assembly 12 to the adjacent pipe section 10*a* of the drill stem. The opposite end of coupling 20 is connected to an adapter coupling 21. The inner end of the lock coupling in conjunction with the annular recess 21*a* of the adapter coupling forms a latch seat inside the surface of the adapter coupling against which the latches (detents) 16, 17 of the core barrel inner tube assembly are seated for removably retaining the assembly 15 adjacent to the core bit. Also, the inner end of the lock coupling has a projection flange (not shown) to bear against a latch in the latch seated condition to rotate the adjacent parts of the core barrel inner tube assembly with the drill stem.

Threadedly connected to the inner end of adapter coupling is the outer end of the core barrel outer tube 18 which has an annular recess 18*a* to receivingly mount a landing ring 23 in abutting engagement with the adapter coupling. The inner diameter of the landing ring is sufficiently smaller than the inner diameter of the remaining portion of the drill stem that is axially outwardly of the core bit to form a suspension shoulder in the core barrel outer tube.

The core barrel inner tube assembly 15 includes a latch body 26 having a pair of latches (detents) 16, 17 and a latch insert block 25 mounted in an axially elongated latch body slot 26*a*, an axially elongated latch release tube 27 for retracting said latches, an inner tube cap 29 threaded onto the outer end of the core barrel receiving (inner) tube 28 and a spindle (not shown) for connecting the cap to the inner end of the latch body for limited slidable movement. Bearing and shutoff washer structure and other structure that is mounted on the spindle has not been illustrated, nor will be described since the construction and function thereof may be the same as set forth in U.S. Pat. No. 3,461,981. The latch body has a reduced diameter lower end portion of a smaller diameter than the inner diameter of ring 23 and adjacent thereto an enlarged diametric portion that in conjunction with the reduced diameter portion provides an annular landing shoulder 26B. When shoulder 26B is seated on the landing ring 23, the core receiving tube is retained out of abutting engagement with the core barrel outer tube assembly and at the same time the fluid bypass channel 30 permits fluid to flow from the annular space between the core barrel inner tube assembly and the core barrel outer tube assembly that is above ring 23 to the annular clearance space axially below the ring 23.

A through pin 32 mounts the insert block in the latch body slot while a through pin 33 mounts the latches 16, 17 for pivotal movement between the retracted and latched seated positions. The latch release tube 27 is mounted on the upper reduced diameter portion of the latch body for limited axially slidable movement relative thereto between a position abutting against latch body shoulder 34 to permit the latches moving to a latch seated position, and a latch retracted position axially thereabove. Tube 27 has diametrically opposed slots 35 through which the outer transverse corner portion of the latches may extend to latchingly engage latch seat 21*a*, a torsion spring being provided to resiliently urge the latches to their latch seated position. An axially elongated slot 37 is formed in the latch body on either side of slot 26*a* to extend transversely therethrough. A through pin 36 is extended through slots 26*a*, 37 and has its opposite ends mountedly retained within opposed apertures in the latch release tube to remove therewith. The slots 37 extend axially inwardly sufficiently that when the pin 36 abuts against the inner edges thereof, the pin is located transversely intermediate the latches, and the latch tube abuts against latch body shoulder 34; and when the pin is in an axially outer position, the latch release tube has moved sufficiently relative the latch body to retract the latches. Thus, pin 36 allows limited axial movement of the latch release tube relative the latch body.

A knuckle joint assembly (coupling assembly) K includes a spearhead base, generally designated 42, that has an enlarged cylindrical portion 43 slidably extended into the outer end of the latch release tube. A pin 55 extends through a slot in cylindrical portion 43 and is mounted by the latch release tube to permit limited axial movement of the spearhead base relative the latch release tubes. Integrally joined to the cylindrical portion 43 is an axial intermediate portion 44 that is cylindrical other than for transversely opposite, generally planar axially extending parallel surface 47. The radius of curvature of the circumferential surfaces of intermediate portion 44 is substantially less than that of cylindrical portion 43. Integrally joined to the intermediate portion is an axial outer end portion 45 that has transversely opposite surfaces 45A which are arcuately curved in transverse planes, convergently tapered in an axial outer direction and converge toward the central axis of the base. Formed within the outer end portion 45 is a generally triangular recess 46 which has its base axially outwardly of its apex portion, is centrally located relative tapered surfaces 45A, and has its apex edge extending perpendicular to surfaces 47. The surfaces of the base between and joining surfaces 45A to the axially inwardly convergingly tapered, generally planar surfaces defining most of recess 46 are rounded at 48.

The assembly K also includes a point subassembly, (overshot coupling member) generally designated 49, that has a cylindrical portion 50. A rectangular slot is provided in the axial inner end portion of cylindrical portion 50 to provide a pair of legs 50*a* which extend along the planar surfaces 47 of intermediate portion 44. A transverse pin 54 pivotally connects the legs to the spearhead base adjacent the juncture of portions 44, 45.

Cylindrical portion 50 is integrally joined to the major base end of the frustoconical potion 51 while the minor base end thereof is integrally joined to a reduced diameter cylindrical portion 52. The opposite end of the cylindrical portion 52 is integrally joined to the base of the frustoconical point 53. The cylindrical portion 50 has a bore 56 that opens to the rectangular slot between the legs 50*a*, a detent (plunger) 57 being slidably mounted in the bore. A coil spring 58 has one end seated in a recess in the detent and an opposite end against a wall that in part defines the bore for resiliently urging the detent toward pin 54. The axial inner end portion of the detent has generally planar opposite surfaces 57*b* that are convergingly tapered in an axial inward direction and are joined by a rounded axial inner surface portion (apex edge) 57*a*. The angles of taper of the surfaces 57*b* are about the same and opposite of the angles of taper of the tapered walls defining recess 46. Thus, the axial inner end portion of the detent is extendable into recess 46 with surfaces 57*b* abutting against the tapered surfaces of recess 46.

Assuming the spearpoint subassembly is in the 90° position of FIG. 3, as the subassembly is pivoted about pivot 54 in a direction opposite arrow 87, plunger 57 moves closer to the axis of the pivot until about the 60° to 70° position (depending on the slope of surfaces 45*a*) and thence moves further from said axis. As the plunger end 57*a* moves along surface 48 it is moved to an angular position that the surface starts to curve axially inwardly in a direction toward the central axis X—X of the base member (about 25° angular position for the structure illustrated). The characteristics of spring 58 are such that at this angular position (about 25°), the point subassembly (unless manually restrained) will snap to the zero degree position of FIG. 1 that the central axes Y—Y and X—X respectively, of the subassembly and base member 42 are substantially aligned and will be resiliently retained in such a position until a sufficiently great external force is applied to pivot the subassembly relative the base member in the direction of arrow 87, or opposite arrow 87. Also, it is to be noted that due to the axially intermediate portions of surfaces 45*a* being more closely adjacent the axis of pivot 54 than the axial opposite ends of said surfaces, at the time end portion 57*a* abuts against one of said intermediate portions the subassembly will be resiliently retained in about 50°–70° angular position relative the base central axis until a sufficiently great external force is applied to pivot it from such an angular position.

For purposes of retracting the core barrel inner tube assembly through the drill stem there is provided an overshot assembly, generally designated 70, which includes a pair of overshot dogs 72 that are pivotally mounted by a pivot pin 73 in a slot provided within an intermediate part of the overshot dog mounting member 71. The dogs 72 have jaws 72*a* which are shaped for retaining the spear point assembly 49 therebetween. A coil spring (not shown) is mounted by the outer ends of the dogs to resiliently urge the jaws 72*a* together to a grasping position while permitting expansion of the jaws to slide over the spearpoint 53 to grasp the spearpoint assembly such as shown in FIG. 1. The mounting member 71 has an annular stabilizing collar 71*a* axially inwardly of the dogs, the collar having a cylindrical inner surface that is of about the same axial length as that of portion 50 and only of a slightly larger inner diameter than the outer diameter of portion 50. The stabilizing collar prevents any significant pivotal movement of the coupling member about a transverse axis when the overshot assembly is couplingly attached to the inner tube assembly.

The outer end portion 75 of the overshot head is threadedly connected to the overshop dog mounting member 71, the outer end portion having a central aperture into which one end of a jar staff (rod) 78 is fitted and held in place by a pin (not shown). The rod 78 is slidably extended through a jar head 79 which in turn is threadedly mounted by the inner end portion of the jar tube 80. A nut is threaded on the outer end of the rod to limit the movement of the jar head axially away from the overshot head 71, 75. A mount 81 is threadedly connected to the outer end of the jar tube for having one end of the wire line 82 connected thereto. Since the overshot assembly may be of a construction such as shown in U.S. Pat. No. 2,829,868, other than for modifying the stabilizing collar, it will not be further described.

Axially outwardly of pin 55 the latch release tube 27 is provided with a pair of diametrically opposed, rectangular slots 85 that open to the axially outer transverse edge of the tube. The slots are of a axial length that when the spearhead base 42 is in its axial inner position relative to latch release tube, the pivot 54 is located axially outwardly of the axial inner transverse edges of the slots whereby the point subassembly 49 can be pivoted through a substantial angle relative the spearhead base prior to the overshot head 71 abutting against the latch release tube. When the spearpoint base is in its axial outer position of FIGS. 1 and 3 relative the latch release tube, the pivot axis of pivot member 54 is located slightly axially outwardly of the outer transverse edge of the latch release tube. The slots are located on transverse opposite sides of the pivot member 54 and are of transverse dimensions sufficiently great that the legs 50*a* may extend through one of the sots when the spearpoint subassembly 49 is pivoted from a position that its central axis is aligned with the central axis of the spearhead base to a position that its central axis extends about 90° relative the spearhead base central axis.

Assuming the overshot assembly is coupled to the core barrel inner tube assembly such as shown in FIGS. 1 and 2, further retraction of the overshot assembly will move the latch release tube to retract the latches and thence the inner tube assembly through the drill stem. The wire line hoist is used to elevate the coupled combination so that the inner end is completely above the drill stem. Thereafter the operator moves the core barrel inner tube assembly to move the inner end thereof away from the drill stem and at the same time the wire line hoist is operated to lower the overshot assembly. As a result the base member will pivot about pivot 54 relative the subassembly 49 to cam the plunger out of recess 46. That is, as the inner end of the inner tube assembly is moved away from the drill stem, due to the slope of the tapered surfaces of the recess and the rounded edge 57*a* the plunger is moved in the bore axially away from the pivot axis of pivot member 54 and the base member angularly in the direction opposite of arrow 87 about the axis of pivot 54. At the time the apex portion 57*a* abuts against the rounded surface 48 at the juncture of one of the base surfaces 45*a* and recess 46, the plunger is at its maximum radial spacing from pivot member 54. As the base member 49 is pivoted further in the direction opposite of arrow 87, due to the slope of surface 45, the plunger moves progressively closer to the pivot axis of pivot member 54 up until the central axis of the point subassembly extends at about a 50°–70° angle relative the central axis of the spearhead bases. Further movement of the base member in the direction opposite of the arrow 87 results in the plunger being cammed axially away from the pivot axis of pivot member 54. The base member can be pivoted relative the spearpoint subassembly to the about 90° position of FIG. 3 (or 90° in the opposite direction relative the subassembly). Thus the spearpoint subassembly can be pivoted relative the base member through an angle of about 180°, the slots 85 permitting the overshot stabilizing collar 71*a* being in either of the 90° positions without abutting against the latch release tube when the base member is in its axial outer position relative the release tube.

When the inner tube assembly has been moved (manually and by operating the wire line hoist to lower the overshot assembly) so that the inner tube assembly is flat on the surface, for example that of the earth, the subassembly extends upwardly at a substantial angle (usually about 60°-90°). Now the overshot dogs are operated to release their coupling engagement with the spearpoint subassembly, and the overshot assembly while still attached to the wire line hoist moved to be coupled to the spearpoint subassembly of an adjacent second inner tube assembly that has its spearpoint subassembly extended upwardly at a substantial angle. Now the wire line hoist is operated to elevate the overshot assembly which in turn elevates the spearpoint subassembly. This results in the base member being elevated and pivoting in the direction of arrow 87 whereby the inner end of the second inner tube assembly moves along the surface toward the drill stem. When the overshot assembly has been elevated sufficiently that the inner tube assembly is closely adjacent the drill stem, the plunger moves into recess 46 and retains the spearpoint subassembly in the near zero degree position (central axes substantially aligned) when the inner tube assembly inner end is out of abutting relationship with the surface and other structure.

Due to the knuckle joint provided by the base member and spearpoint subassembly, bending takes place at pivot 54 rather than at the jar staff. With reference thereto it is to be noted many overshot assemblies when the overshot head is axially remote from the jar tube are about 7 feet or greater in length and many inner tube assemblies are over 13 feet in length. Since the inner tube assembly can pivot at 54 relative the overshot assembly the overshot assembly can be retained in coupling engagement with the inner tube assembly from the time it is coupled thereto to retract it through the drill stem until the time the inner tube assembly is laid down in a substantially horizontal position on the earth's surface. As a result the jar staff is not bent and considerably less handling is required than where a main hoist is also used. This saves time and decreases the likelihood of injury to the operator. Further, these advantages can be obtained by merely substituting the latch release tube and knuckle joint assembly K of this invention for the spearpoint plug and latch release tube of a conventional wire line core barrel inner tube assembly and using an overshot assembly having a stabilizing collar such as described herein.

What is claimed:

1. For core drilling apparatus that includes a drill stem having a hollow bit end and a latch seat spaced from the bit end, an elongated core barrel inner tube assembly that includes means for collecting a core sample, a latch body connected to the core sample collecting means, detent means mounted by the latch body for movement between a latch seat engaging position and a retracted latch seat release position, release means for operating the detent means between the detent means latch seat engaging position and the latch seat release position, said release means being mounted on the latch body for axial movement relative thereto between an axial inner position that the detent means is extendable into the latch seat to latchingly engage the latch seat and an axial outer position that the detent means is retracted from the latch seat, and overshot coupling means attached to the release means for moving the release means between its positions, said coupling means including a base member, means for joining the base member to the release means, an overshot coupling member and means mounting the coupling member on the base member for movement about an axis transverse to the direction of axial movement of release means between its positions.

2. The apparatus of claim 1 further characterized in that the means for mounting the coupling member on the base member comprises a transverse pivot member.

3. The apparatus of claim 1 further characterized in that each of the coupling member and the base member has a central axis, the coupling member being movable relative the base member between a position that the coupling member axis is substantially aligned with the base member axis and a position that the coupling member axis extends at a substantial angle relative the base member axis, and that the coupling means includes means mounted by one of the coupling member and the base member and acting in cooperation with the other of the coupling member and the base member to resiliently retain said members in relative positions that their axes are substantially aligned.

4. The apparatus of claim 3 further characterized in that the coupling member has an intermediate portion and legs joined to the intermediate portion and extending along transversely opposite sides of the base member, that the means for mounting the coupling member on the base member comprises a transverse pivot member pivotally connecting the legs to the base member to permit the coupling member being pivoted through an angle of about 180°.

5. The apparatus of claim 4 further characterized in that the release means comprises an axial elongated tubular member, that the base member slidably extends within the tubular member and has an axial elongated slot, and that the means for joining the base member to the release means comprises a transverse pin mounted by the tubular member and extended through the above mentioned slot to limit the axial movement of the base member relative the tubular member between an axial inner position and an axial outer position, the tubular member having an axially outer transverse edge and diametrically opposite slots opening axially through the outer transverse edge, the tubular member having wall portions defining axially inner transverse slot edges, the tubular member slots being axially adjacent and on transverse opposite sides of the pivot axis when the base member is in its axial outer position, and the pivot axis being axially intermediate the outer and inner transverse edge when the base member is in its axial inner position.

6. The apparatus of claim 1 further characterized in that each of the coupling member and the base member has a central axis, the coupling member being movable relative the base member between a first position that the coupling member axis is substantially aligned with the base member axis, a second position that the coupling member axis extends at a substantial angle relative the base member axis, and a third position intermediate the first and second positions, and that the coupling means includes means mounted by one of the coupling member and the base member and acting in cooperation with the other of the coupling member and the base member to resiliently urge said members to move relative one another to their first position when said members are in their third position.

7. For core drilling apparatus that includes a drill stem having a hollow bit end and a latch seat spaced from the bit end, an elongated core barrel inner tube assembly that includes means for collecting a core sample, a latch body connected to the core sample collecting means, detent means mounted by the latch body for movement between a latch seat engaging position and a retracted latch seat release position, release means for operating the detent means between the detent means latch seat engaging position and the latch seat release position, said release means being mounted on the latch body for axial movement relative thereto between an axial inner position that the detent means is extendable into the latch seat to latchingly engage the latch seat and an axial outer position that the detent means is retracted from the latch seat, and overshot coupling means attached to the release means for moving the release means between its positions, said coupling means including a base member, means for joining the base member to the release means, an overshot coupling member and means mounting the coupling member on the base member for movement about an axis transverse to the direction of axial movement of release means between its positions, each of the coupling member and the base member having a central axis, the coupling member being movable relative the base member between a position that the coupling member axis is substantially aligned with the base member axis and a position that the coupling member axis extends at substantial angle relative the base member axis, the coupling means including means mounted by one of the coupling member and the base member and acting in cooperation with the other of the coupling member and the base member to releasably retain said members in relative positions that their axes are substantially aligned, the last mentioned means comprising resiliently urged detent means mounted by the coupling member and resiliently retained in abutting relationship with the base member to releasably retain the said members in relative positions that their axes are substantially aligned, the base member having a recess for the last mentioned detent means to extend into when said member axes are substantially aligned.

8. The apparatus of claim 7 further characterized in that the base member has surface portions on transverse opposite sides of the base member axis that converge toward said recess and located such that the detent means abuts against one of said surface portions when the coupling member axis extends at one substantial angle to base member axis and abuts against the other of said surface portions when the coupling member axis extends at a second substantial angle to the base member axis that is equal and opposite said one substantial angle.

9. The apparatus of claim 8 further characterized in that each of said surface portions has axially opposite first and second end portions, and that the means for mounting the coupling member on the base member comprises a transverse pivot member having a pivot axis transversely between the surface portions, the pivot member axis being located more closely adjacent each of the surface portions axially intermediate the surface portions end portions than the end portions.

10. In core drilling drilling apparatus, an axially elongated latch release tube having an axial outer end portion, a base member, means for joining the base member to the release tuber outer end portion, an overshot coupling member, said members each having a central axis, means for connecting said members together for relative movement between a position said central axes are substantially aligned and a position that the central axes are inclined at a substantial angle relative one another, and means mounted by one of said members and acting in cooperation with the other of said members to releasably resiliently retain said members in a first position that their axes are substantially aligned and alternately in a second position that their axes are inclined at substantial angles relative one another.

11. For core drilling apparatus that includes a drill stem having a hollow bit end and a latch seat spaced from the bit end, an elongated core barrel inner tube assembly that includes means for collecting a core sample, a latch body connected to the core sample collecting means, detent means mounted by the latch body for movement between a latch seat engaging position and a retracted latch seat release position, release means for operating the detent means between the detent means latch seat engaging position and the latch seat release position, said release means being mounted on the latch body for axial movement relative thereto between an axial inner position that the detent means is extendable into the latch seat to latchingly engage the latch seat and an axial outer position that the detent means is retracted from the latch seat, and overshot coupling means attached to the release means for moving the release means between its position, said coupling means including a base member, means for joining the base member to the release means, an overshot coupling member and means mounting the coupling member on the base member for movement about an axis transverse to the direction of axial movement of release means between its positions, each of the coupling member and the base member having a central axis, the coupling member being movable relative the base member between a position that the coupling member axis is substantially aligned with the base member axis and a position that the coupling member axis extends at a substantial angle relative the base member axis, the coupling means including means mounted by one of the coupling member and base member and acting in cooperation with the other of the coupling member and the base member to releasably retain said members in relative positions that their axes are substantially aligned, the coupling member having an intermediate portion and legs joined to the intermediate portion and extending along transversely opposite sides of the base member, the intermediate portion having a bore opening between the legs toward the base member, the base member having a recess opening toward said bore when said members are in relative positions that their axes are substantially aligned, the coupling means including a detent plunger slidably mounted in said bore and extendable into said recess when said member axes are substantially aligned, and resilient means on the coupling member for resiliently retaining the plunger in abutting relationship to the base member, and the means for mounting the coupling member on the base member comprising a transverse pivot member pivotally connecting the legs to the base member to permit the coupling member being pivoted through an angle of about 180°.

12. For core drilling apparatus that includes a drill stem having a hollow bit end and a latch seat spaced from the bit end, an elongated core barrel inner tube assembly that includes means for collecting a core sample, a latch body connected to the core sample collecting means, detent means mounted by the latch body for movement between a latch seat engaging position and a retracted latch seat release position, release means for operating the detent means between the detent means latch seat engaging position and the latch seat release position, said release means being mounted on the latch body for axial movement relative thereto between an axial inner position that the detent means is extendable into the latch seat to latchingly engage the latch seat and an axial outer position that the detent means its retracted from the latch seat, and overshot coupling means attached to the release means for moving the release means between is positions, said coupling means including a base member, means for joining the base member to the release means, an overshot coupling member and means mounting the coupling member on the base member for movement about an axis transverse to the direction of axial movement of release means between its positions, each of the coupling member and the base member having a central axis, the coupling member being movable relative the base member between a position that the coupling member axis is substantially aligned with the base member axis and a position that the coupling member axis extends at a substantial angle relative the base member axis, the coupling means including means mounted by one of the coupling member and the base member and acting in cooperation with the other of the coupling member and the base member to releasably retain said members in relative positions that their axes are substantially aligned, the coupling member having an intermediate portion and legs joined to the intermediate portion and extending along transversely opposite sides of the base member, the means for mounting the coupling member on the base member comprising a transverse pivot member having a transverse pivot axis pivotally connecting the legs to the base member to permit the coupling member being pivoted through an angle of about 180°, the base member having an axially outwardly opening recess and a surface portion on one transverse of the pivot member and base member axes that converges toward the base member axis in an axial outer direction, the surface portion having an axial outer edge adjacent said recess and an axial inner edge axially on the opposite side of the pivot axis from the recess, and the coupling means having plunger means mounted by the coupling member and resiliently urged to extend into said recess when the base and coupling member axes are substantially aligned to releasably retain the base and coupling members in such a position and resiliently urged to abut against said surface portion when the base member axis extends at a substantial angle relative the coupling member axis to releasably retain the coupling member so that its axis extends to a preselected angle relative the base member axis.

13. In core drilling drilling apparatus, an axially elongated latch release tube having an axial outer end portion, a base member, means for joining the base member to the release tube outer end portion, an overshot coupling member, said members each having a central axis, means for connecting said members together for relative movement between a position said central axes are substantially aligned and a position that the central axes are inclined at a substantial angle relative one another, and means mounted by one of said members and acting in cooperation with the other of said members to releasably retain said members in a first position that their axes are substantially aligned and alternately in a second position that their axes are inclined at substantial angles relative one another, the said other of the members having a detent receiving recess, the releasably retaining means including a detent and means for resiliently urging the detent into the recess when the base and coupling members are in the position their axes are substantially aligned, and the means for connecting the members together comprising a pivot having a pivot axis transverse to the direction of elongation of the release tube.

14. The apparatus of claim 13 further characterized in that the detent and resilient means are mounted by the coupling member, and that the base member has a surface portion that converges toward the base member central axis in a direction toward said recess and at a location that the detent abuts thereagainst when the coupling and base members are in a relative position that their axes are substantially out of alignment with one another.

* * * * *